US009970274B2

(12) United States Patent
Themig et al.

(10) Patent No.: US 9,970,274 B2
(45) **Date of Patent: *May 15, 2018**

(54) WELLBORE TREATMENT APPARATUS AND METHOD

(71) Applicant: PACKERS PLUS ENERGY SERVICES INC., Calgary (CA)

(72) Inventors: Daniel Jon Themig, Calgary (CA); Christopher Denis Desranleau, Sheerwood Park (CA); Robert Joe Coon, Missouri City, TX (US)

( * ) Notice: Subject to any disclaimer, the term of this patent is extended or adjusted under 35 U.S.C. 154(b) by 161 days.

This patent is subject to a terminal disclaimer.

(21) Appl. No.: 14/830,947

(22) Filed: Aug. 20, 2015

(65) Prior Publication Data

US 2016/0168966 A1 Jun. 16, 2016

Related U.S. Application Data

(63) Continuation of application No. 13/519,173, filed as application No. PCT/CA2010/002072 on Dec. 30, 2010, now Pat. No. 9,140,097.

(Continued)

(51) Int. Cl.
*E21B 33/126* (2006.01)
*E21B 33/14* (2006.01)

(Continued)

(52) U.S. Cl.
CPC ..... *E21B 43/16* (2013.01); *E21B 33/12* (2013.01); *E21B 33/134* (2013.01);

(Continued)

(58) Field of Classification Search
CPC ..... E21B 33/134; E21B 33/146; E21B 34/14; E21B 43/04; E21B 43/045; E21B 37/08
See application file for complete search history.

(56) References Cited

U.S. PATENT DOCUMENTS 958,100 A 5/1910 Decker
2,177,172 A 10/1939 Crowell (Continued)

FOREIGN PATENT DOCUMENTS

CA 2625662 A1 11/2008
EP 2360347 9/2006

(Continued)

*Primary Examiner* — Cathleen R Hutchins

(57) ABSTRACT

A method for wellbore treatment includes running a liner into a wellbore, the liner including a wall, an inner bore defined by the wall, a first port through the wall, a second port though the wall spaced axially from the first port, a first removable closure for the first port and a second removable closure for the second port; positioning the liner in an open hole section of the wellbore to create an annulus between the liner and a portion of the wellbore wall and with the second port downhole of the first port; inserting a treatment string assembly into the liner, the treatment string assembly including a tubing string and an annular seal about the tubing string and being insertable into the inner bore of the liner; setting the annular seal to create a seal between the tubing string and the liner downhole of the second port; and while the first port is closed to fluid flow therethrough, pumping wellbore treatment fluid into an annular area between the tubing string and the liner such that the fluid passes through the second port and into the annulus to treat the open hole section of the wellbore adjacent the second port. The treatment string assembly may further include a port-opening tool and a fluid communication port permitting fluid communication between the tubing string outer surface and a fluid conduit through the tubing string adjacent an upper side of the annular seal.

18 Claims, 8 Drawing Sheets

Related U.S. Application Data

(60) Provisional application No. 61/292,108, filed on Jan. 4, 2010, provisional application No. 61/415,732, filed on Nov. 19, 2010, provisional application No. 61/417,260, filed on Nov. 25, 2010.

(51) Int. Cl.

| | |
|---|---|
| ***E21B 43/04*** | (2006.01) |
| ***E21B 37/08*** | (2006.01) |
| ***E21B 43/16*** | (2006.01) |
| ***E21B 33/134*** | (2006.01) |
| ***E21B 34/06*** | (2006.01) |
| ***E21B 34/12*** | (2006.01) |
| ***E21B 43/26*** | (2006.01) |
| ***E21B 33/12*** | (2006.01) |
| ***E21B 34/14*** | (2006.01) |

(52) U.S. Cl.
CPC ..... *E21B 34/063* (2013.01); *E21B 34/12* (2013.01); *E21B 34/14* (2013.01); *E21B 43/26* (2013.01)

(56) References Cited

U.S. PATENT DOCUMENTS

| | | | | |
|---|---|---|---|---|
| 2,287,076 | A | | 6/1942 | Zachry |
| 2,344,120 | A | | 3/1944 | Baker |
| 2,431,751 | A | | 12/1947 | Hayward |
| 2,903,074 | A | | 9/1959 | Layton et al. |
| 2,922,479 | A | | 1/1960 | Kinley |
| 3,051,143 | A | | 8/1962 | Nee |
| 3,095,040 | A | | 6/1963 | Bramlett |
| 3,696,867 | A | * | 10/1972 | Waid ..... E21B 43/04 166/276 |
| 3,924,677 | A | | 12/1975 | Prenner et al. |
| 4,068,712 | A | | 1/1978 | Stump |
| 4,154,303 | A | | 5/1979 | Fournier |
| 4,374,543 | A | | 2/1983 | Richardson |
| 4,378,839 | A | | 4/1983 | Fisher, Jr. |
| 4,566,541 | A | | 1/1986 | Moussy et al. |
| 4,577,702 | A | | 3/1986 | Faulkner |
| 4,601,343 | A | | 7/1986 | Lindsey, Jr. et al. |
| 4,603,741 | A | | 8/1986 | Edgmon |
| 4,693,314 | A | | 9/1987 | Wesson et al. |
| 4,729,432 | A | | 3/1988 | Helms |
| 4,846,272 | A | | 7/1989 | Leggett |
| 4,893,678 | A | | 1/1990 | Stokley et al. |
| 4,917,191 | A | | 4/1990 | Hopmann et al. |
| 4,928,772 | A | | 5/1990 | Hopmann |
| 4,949,788 | A | | 8/1990 | Szarka et al. |
| 5,012,871 | A | | 5/1991 | Pleasants et al. |
| 5,305,833 | A | | 4/1994 | Collins |
| 5,413,180 | A | | 5/1995 | Ross et al. |
| 5,526,881 | A | | 6/1996 | Martin et al. |
| 5,803,173 | A | | 9/1998 | Fraser, III et al. |
| 6,003,607 | A | | 12/1999 | Hagen et al. |
| 6,006,838 | A | | 12/1999 | Whiteley et al. |
| 6,220,316 | B1 | | 4/2001 | Lin |
| 6,220,356 | B1 | | 4/2001 | Spikes |
| 6,382,324 | B1 | | 5/2002 | Anyan |
| 6,397,950 | B1 | | 6/2002 | Streich et al. |
| 6,763,892 | B2 | | 7/2004 | Kaszuba |
| 6,920,930 | B2 | | 7/2005 | Allamon et al. |
| 6,945,331 | B2 | | 9/2005 | Patel |
| 6,997,263 | B2 | | 2/2006 | Campbell et al. |
| 7,051,812 | B2 | | 5/2006 | McKee et al. |
| 7,287,596 | B2 | | 10/2007 | Frazier et al. |
| 7,387,165 | B2 | | 6/2008 | Lopez de Cardenas et al. |
| 7,431,091 | B2 | | 10/2008 | Themig et al. |
| 7,533,727 | B2 | | 5/2009 | Barton et al. |
| 7,543,634 | B2 | | 6/2009 | Fehr et al. |
| 7,673,677 | B2 | | 3/2010 | King et al. |
| 7,703,510 | B2 | | 4/2010 | Xu |
| 7,708,066 | B2 | | 5/2010 | Frazier |
| 7,730,949 | B2 | | 6/2010 | Guignard et al. |
| 7,748,460 | B2 | | 7/2010 | Themig et al. |
| 2003/0127227 | A1 | | 7/2003 | Fehr et al. |
| 2004/0035586 | A1 | | 2/2004 | Gudmestad et al. |
| 2006/0124310 | A1 | | 6/2006 | Lopez et al. |
| 2006/0207764 | A1 | | 9/2006 | Rytlewski |
| 2007/0185655 | A1 | * | 8/2007 | Le Bemadjiel ..... E21B 43/04 702/6 |
| 2007/0221373 | A1 | | 9/2007 | Murray |
| 2007/0272411 | A1 | | 11/2007 | Lopez de Cardenas et al. |
| 2008/0156498 | A1 | | 7/2008 | Phi et al. |
| 2008/0289813 | A1 | | 11/2008 | Gewily et al. |
| 2009/0044944 | A1 | | 2/2009 | Murray et al. |
| 2009/0065194 | A1 | | 3/2009 | Frazier |
| 2009/0084553 | A1 | | 4/2009 | Rytlewski et al. |
| 2009/0139717 | A1 | | 6/2009 | Richard et al. |
| 2009/0139726 | A1 | | 6/2009 | Gomez |
| 2009/0159279 | A1 | | 6/2009 | Assal |
| 2010/0000727 | A1 | | 1/2010 | Webb et al. |
| 2010/0038096 | A1 | | 2/2010 | Reimert et al. |
| 2010/0263873 | A1 | | 10/2010 | Turner et al. |
| 2010/0282469 | A1 | | 11/2010 | Richard et al. |
| 2011/0030968 | A1 | | 2/2011 | Xu |
| 2011/0030976 | A1 | | 2/2011 | King |
| 2011/0088908 | A1 | | 4/2011 | Xu |
| 2011/0079391 | A1 | | 7/2011 | Themig et al. |
| 2011/0192613 | A1 | | 8/2011 | Garcia et al. |
| 2013/0168090 | A1 | | 7/2013 | Themig et al. |
| 2014/0151052 | A1 | | 6/2014 | Themig et al. |

FOREIGN PATENT DOCUMENTS

| | | |
|---|---|---|
| GB | 2258478 | 2/1993 |
| WO | WO 2008/119931 | 10/2008 |
| WO | WO 2009/029437 A1 | 3/2009 |
| WO | WO 2009/132462 | 5/2009 |
| WO | WO 2010/025150 A2 | 3/2010 |
| WO | WO 2011/079391 | 7/2011 |
| WO | WO 2011/079391 A1 | 7/2011 |
| WO | WO 2011/097632 A1 | 8/2011 |
| WO | WO 2011/100748 | 8/2011 |

* cited by examiner

WELLBORE TREATMENT APPARATUS AND METHOD

FIELD

The invention is directed to a wellbore treatment apparatus and method.

BACKGROUND

There is a desire to effect wellbore fluid treatment to improve wellbore production. It is convenient and presents a time and cost benefit if the treatment can be carried out without tripping numerous times in and out of the wellbore.

SUMMARY

In accordance with a broad aspect of the present invention, there is provided an apparatus for wellbore treatment comprising: a liner including a wall, an inner bore defined by the wall, a first port through the wall, and a second port though the wall spaced axially from the first port; and a treatment string assembly insertable into the inner bore of the liner, the treatment string including a tubing string with a lower end, an outer surface and a fluid conduit through which fluid can be conveyed through the string, a fluid communication port permitting fluid communication between the outer surface and the fluid conduit, a port-opening tool carried on the tubing string and an annular seal about the outer surface of the tubing string positioned between the fluid communication port and the lower end.

In accordance with another broad aspect of the present invention, there is a provided a method for wellbore treatment, the method comprising: running into a wellbore with a liner including a wall, an inner bore defined by the wall, a first port through the wall and a second port though the wall spaced axially from the first port; positioning the liner in a wellbore to create an annulus between the liner and a portion of the wellbore wall with the second port positioned further downhole than the first port; inserting a treatment string assembly into the liner creating an annular space between the treatment string assembly and the liner wall, the treatment string assembly including a treatment string assembly insertable into the inner bore of the liner, the treatment string including a tubing string with a lower end, an outer surface and a fluid conduit through which fluid can be conveyed through the string, a fluid communication port permitting fluid communication between the outer surface and the fluid conduit, a port-opening tool carried on the tubing string and an annular seal about the outer surface of the tubing string positioned between the fluid communication port and the lower end; manipulating the port-opening tool to open the second port permitting fluid communication through the second port between the annular space and the annulus; manipulating the annular seal to create a seal in the annular space downhole of the second port; pumping wellbore treatment fluid into the annular space above the seal such that the fluid passes through the second port and into the annulus to treat the wellbore; and allowing fluid communication between the annular space above the seal and the fluid conduit.

In accordance with another broad aspect of the present invention, there is a provided a method for wellbore treatment, the method comprising: running a liner into a wellbore, the liner including a wall, an inner bore defined by the wall, a first port through the wall, a second port though the wall spaced axially from the first port, a first removable closure for the first port and a second removable closure for the second port; positioning the liner in an open hole section of the wellbore to create an annulus between the liner and a portion of the wellbore wall and with the second port downhole of the first port; inserting a treatment string assembly into the liner, the treatment string assembly including a tubing string and an annular seal about the tubing string and being insertable into the inner bore of the liner; setting the annular seal to create a seal between the tubing string and the liner downhole of the second port; and while the first port is closed to fluid flow therethrough, pumping wellbore treatment fluid into an annular area between the tubing string and the liner such that the fluid passes through the second port and into the annulus to treat the open hole section of the wellbore adjacent the second port.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 4*a* is a first sectional view through the port and FIGS. 4*b* to 4*g* are sequential views along line I-I of FIG. 4*a*.

DESCRIPTION OF VARIOUS EMBODIMENTS

Figure 1:
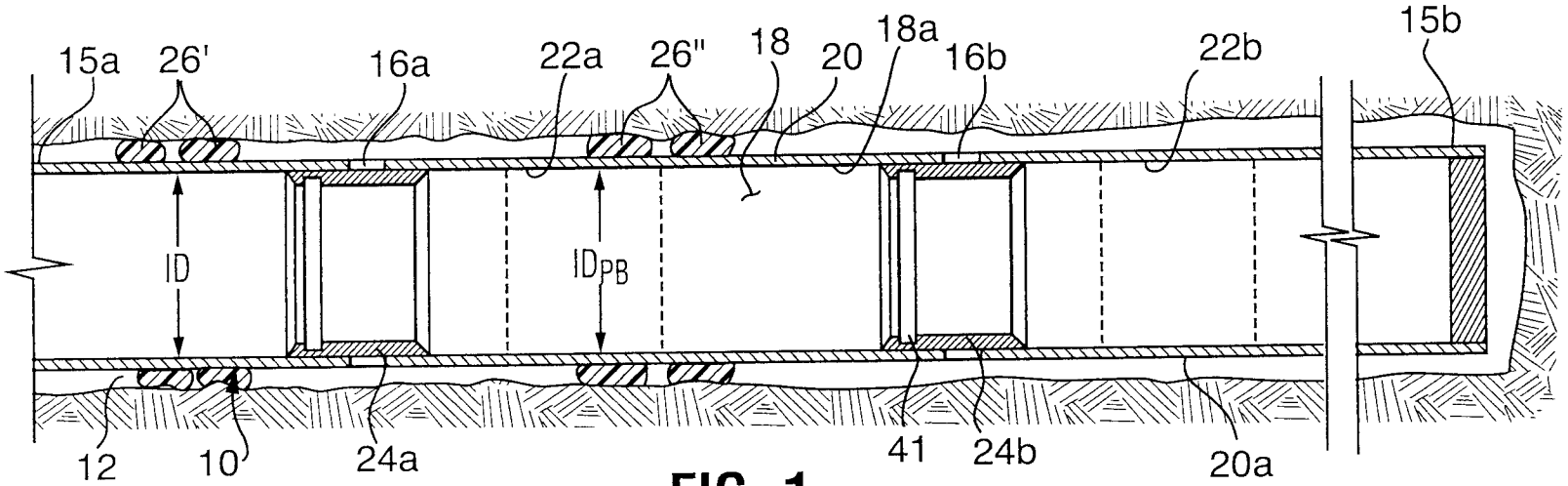
FIG. 1 is a schematic sectional view through a wellbore with a liner installed therein.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features An apparatus for wellbore treatment may operate in a liner 10 installable in a wellbore 12 and include a treatment string assembly 14 insertable into the liner.

The liner may have a tubular form and include an upper end 15*a*, a lower end 15*b* and a plurality of fluid outlet ports extending through the liner wall to provide fluid communication between the liner's inner bore 18 and the liner's outer surface 20*a*. The plurality of fluid outlet ports may include, for example, a first fluid outlet port 16*a* and a second fluid outlet port 16*b* axially spaced below (i.e. downhole from) the first fluid outlet port. Of course, there may be more than one port at each location, for example as shown. However, for simplicity the description proceeds referencing a single port at each location.

The ports may be selectively openable. In one embodiment, for example, the ports are each closed but openable by actuation thereof. Closures for the ports may include moveable sleeves, caps such as kobe subs, push out plugs, burstable caps, etc.

In one embodiment, for example as shown in FIG. 1, a sleeve 24*a*, 24*b* may be provided for each port location of interest. Sleeves 24*a*, 24*b* may each be selectively openable by movement along the liner, either along the liner's inner diameter or its outer surface, between a port-closed position and a port-open position. In the port-closed position (see sleeve 24*a* in FIG. 3), the sleeve blocks fluid flow through the port and in the port-open position (see sleeve 24*b* in FIG. 3), the sleeve is at least partially removed from over the port such that fluid can flow through the port. The sleeve may be moved in various ways between the port-closed and the port-open positions. In one embodiment, for example, the sleeve is moved by engaging it and moving the sleeve relative to the port with which it is associated. There may be sleeve holders, such as friction fit areas, shear pins, etc. to hold the sleeve in position until it is positively moved. Also, seals may be provided between the sleeve and the liner to resist leakage past the sleeve when it is in a port-closed position. The sleeve may be moveable by mechanical movement, for example, by application of force thereto. External application of force may be necessary to fully move the sleeve or, alternately, the sleeve can include a power assist, such as by use of a biasing means, such as a spring, a pressure or atmospheric chamber, an electrical powering mechanism, etc. While not shown here, any sleeve can be installed in an annular recess so as not to reduce the drift diameter. In such an embodiment, the sleeves may be configured not to protrude beyond the ID and, as such, may avoid the creation of a step or discontinuity in the ID.

While only two ports 16*a*, 16*b* are shown, liner 10 may include any number of ports. In addition, the ports in a liner, although shown here to be substantially similar, can vary in form and function along the length of the liner, as desired. For example, some ports along a length of liner may provide communication from the inner diameter to a hydraulic actuator, rather than extending between the inner diameter and the outer surface, some may be openable only partially, some may have inflow control devices, such as screening, some may include valves for flow control and some may include closures other than sleeves.

In one embodiment, the liner may carry seals 26', 26" on its outer surface to create annular seals about the liner. Seals 26', 26" are commonly called packers. Seals 26', 26" may include packer-types such as cups, inflatables, solid body swellables, solid body compressibles, etc. and any combination thereof. In one embodiment, seals 26', 26" are open hole, solid body packers.

Seals 26', 26", when activated, permit the formation of substantially fluid isolated intervals along the annulus between the liner and the wellbore wall. The isolated intervals along the annulus can be accessed via ports 16*a*, 16*b*. For example, the interval along outer surface 20 between seal 26' and seal 26", which are positioned one on either side of port 16*a*, act to isolate that interval accessed by port 16*a* from an adjacent interval about an adjacent port 16*b* axially spaced from port 16*a*. While seals 26', 26" are shown straddling port 16*a* and separating annular communication between ports 16*a* and 16*b*, it is to be understood that more than one port may be positioned between each adjacent set of seals. For example, one or more further axially spaced ports may be positioned with port 16*a* between seals 26', 26" or, by placement of seals 26', 26", ports 16*a* and 16*b* could, if desired, be open to the same interval, while other ports access other isolated intervals. Because the seals limit annular migration of fluids, all or some annular cementing in open hole boreholes may be avoided by use of such seals.

Wellbore treatment string assembly 14 includes a string 30 and an annular seal 32 disposed about an outer surface of the string. Treatment string assembly 14 is selected to be insertable into the inner diameter of liner 10 with string 30 extending through the liner and annular seal 32 is selected to be capable of creating a seal in the annulus between the liner and the string 30.

String 30 has an upper end extending toward surface, a lower end 30*a*, and an outer diameter less than the drift diameter of the liner such that the string can pass therethrough. String 30 may be formed of coiled tubing, interconnected tubulars, etc. Generally, a string may be of interest in some embodiments with an inner bore 37 forming a fluid conduit and/or some axial compressive strength to provide ability to convey axial force, as such a string may permit fluid conveyance therethrough and may be capable of applying push and/or pull forces.

Where string 30 includes an inner bore 37, the inner bore is normally closed below the seal at the string's lower end 30*a*. Also in such an embodiment, string assembly 14 may further include a fluid communication port 38 providing fluid access between the string's inner bore 37 and the string's outer surface 14*a* above the position of seal 32 (i.e. the seal is positioned between the port and the string's lower end). In particular, if string 14 includes a port 38, the port is positioned between the string's upper end and seal 32. In one embodiment, port 38 may be positioned directly adjacent and above seal 32. As such, port 38 provides that fluid conveyed through the string can be introduced to the annulus through the port above seal 32 and/or fluid from adjacent the string's outer surface can enter the string's inner bore through port 38. If desired, a valve 39 may be provided in port 38 to restrict fluid flow between inner bore 37 and the string's outer surface only in one selected direction and/or at selected pressures.

Seal 32 may be settable as by inflation, extrusion or compression and may be set anywhere in the liner or against selected inner wall areas, such as a polished bore receptacle. Seal 32 is selected to be carried on the treatment string and to create a temporary, removable seal, wherever it is set, to prevent fluid passage through the annular area 36 between the liner inner wall surface 18*a* and string assembly 14. Seal 32 remains attached to the treatment string such that it can be positioned and set and then later, unset and carried along with the string to a new location and set again to create a seal in the new location. Seal 32 may be formed in various ways. In one embodiment, sealing may be of greatest interest to act against passage of fluid from above the seal to below the seal. As such the seal may be only upwardly acting, for example against a pressure differential where the uphole pressure is greater than the downhole pressure. However, for various reasons sealing of seal 32 may be of interest both against downward movement of fluids therepast (i.e. being upwardly acting) and against upward movement of fluids therepast (i.e. being downwardly acting). Seal 32 is formed to create a seal against the liner inner wall but, when unset for example, before and after its use to create a seal in the liner, may pass through the liner past any liner components and port closures. Seal 32 may include one or more annular members such as compressible, inflatable or extrudable packers, such as a packer with a reciprocating J, packer cups, compressible rings, inflatable or extrudable annular members, polished bore receptacle seals, etc. In the illustrated embodiment of FIGS. 1 to 3, seal 32 is a polished bore receptacle seal selected to create a seal with a polished bore receptacle. For example, as shown, at least below ports 16*a*, 16*b*, the inner bore has defined therein a polished bore receptacle 22*a*, 22*b*. Polished bore receptacle 22*a* is positioned below first port 16*a*, in the length between ports 16*a* and 16*b* and polished bore receptacle 22*b* is positioned below second port 16*b*, which is along the length of the liner between port 16*b* and lower end 15*b*. For example, polished bore receptacles 22*a*, 22*b* may be formed by inner wall surface 18*a* of the tubular, which defines inner bore 18, having formed along a portion of its length a section having a polished surface, formed to have a surface texture smoother than the other inner wall surfaces, such a surface commonly being termed a polished bore receptacle. A polished bore receptacle generally may have a smooth cylindrical inner bore designed to receive and seal a tubular having a seal assembly on its outer surface. Polished bore receptacles 22*a*, 22*b* may define an inner diameter $ID_{PB}$ slightly smaller than the inner diameter ID of the remainder of the liner's inner bore.

In one embodiment, string assembly 14 may further include a liner port port-opening tool to open the ports along the liner. The form and operations of the port-opening tool may be selected depending on the form of the closures covering the ports. For example, in the illustrated embodiment of FIGS. 1 to 3, string assembly 14 carries a port-opening tool 40 to engage and move sleeves 24 and, where a sleeve is positioned over its port, port-opening tool 40 may be actable to engage the sleeve and move it away from a blocking position over the port protected by that sleeve. In one embodiment, for example, port-opening tool 40 may include an outwardly extending member 42 operable to engage a landing area in a sleeve and apply therethrough axial force to drive the sleeve along the liner relative to the port. Member 42 may include dogs, fingers, springs, collets, drivers, etc. capable of passing through the liner inner diameter but landing and engaging in a portion of the sleeve, such as groove 41, such that the sleeve can be moved to open its associated port. Sleeve movement can be achieved by movement of the string as the tool engages the sleeve or by other means such as hydraulics in tool 40. In some embodiments, the sleeve may include a driver such that, after being engaged and actuated, the driver will assist with, or complete, the movement of the sleeve away from the port.

Figure 2:
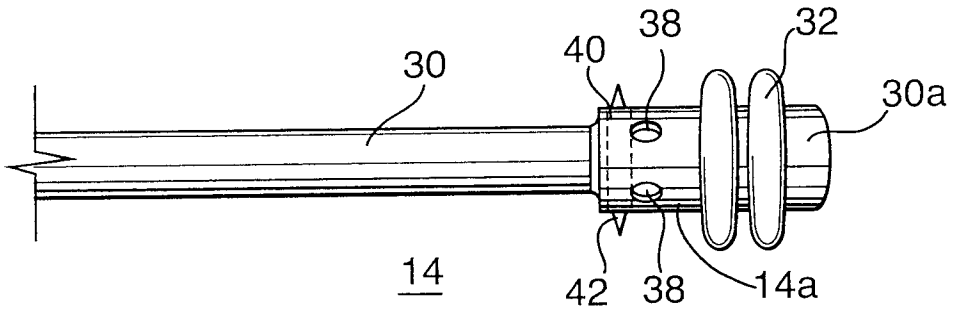
FIG. 2 is a schematic side elevation view of a wellbore treatment tubing string.
Figure 3:
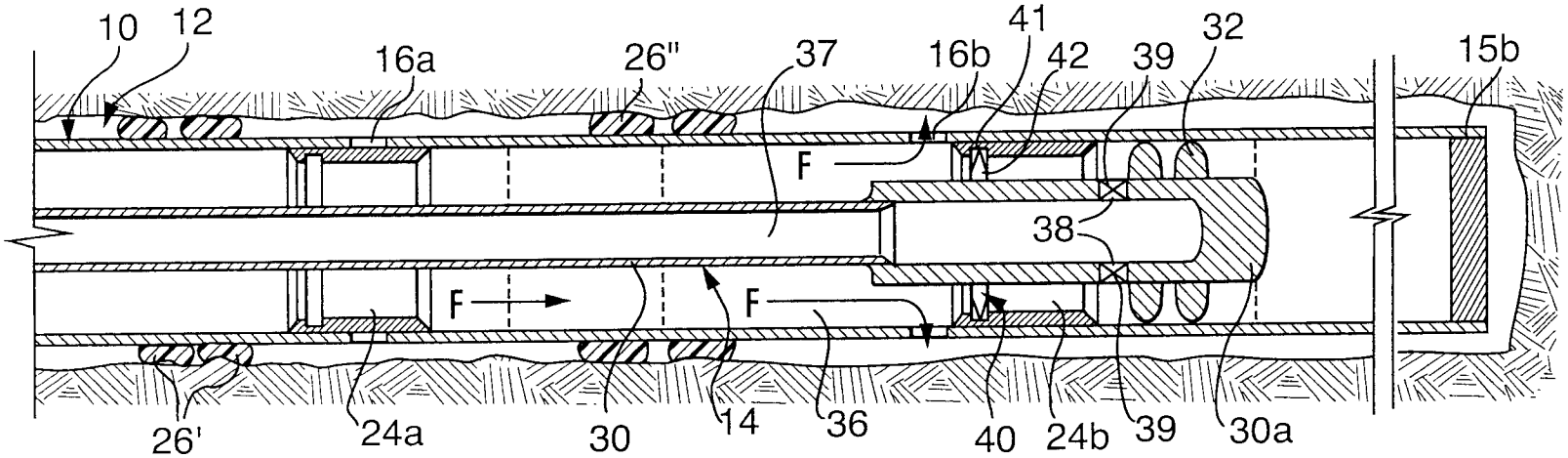
FIG. 3 is a schematic sectional view through a wellbore during a wellbore treatment.

While a closure in the form of a sleeve is shown and described in FIGS. 1 to 3, it is to be understood that other port closures may be useful. For example, a closure may be in the form of a cap. A kobe sub, for example, is a cap that can be mounted at its base over a port with a top cap portion protruding and being removable to open a channel through the cap and therefor the port over which the cap is installed. The cap top portion can be removed by shearing it off, breaking it open, pushing it through the wall, etc. In such an embodiment, the port-opening tool may be selected to pass through the liner inner diameter and remove the cap to open the port. The tool may be formed to cut off, abut against, etc. the top cap portion to open fluid access to the port protected by the cap.

In some embodiments, there they may be concern of a cap being inadvertently removed by abutment by the treatment string or tool head, as it is passed thereby. In such an embodiment, other closures may be employed such as a protected, for example recessed, cap system. In such a system, the cap can be recessed to protect it from abutment of tools and strings passing thereby. For example, as shown in FIG. 4, a port 116 in a liner can have a closure in the form of a cap 146. A channel through the cap actually forms the flow path area of the port, but is normally closed by the top portion of the cap, which overlies and seals access to the channel.

Figure 4A:
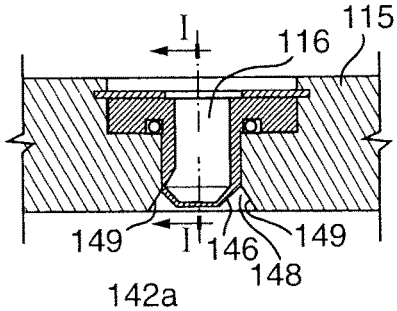
FIGS. 4*a* to 4*g* are sequential schematic sectional drawings through a port showing the opening of a port closure using a treatment string.
Figure 4B:
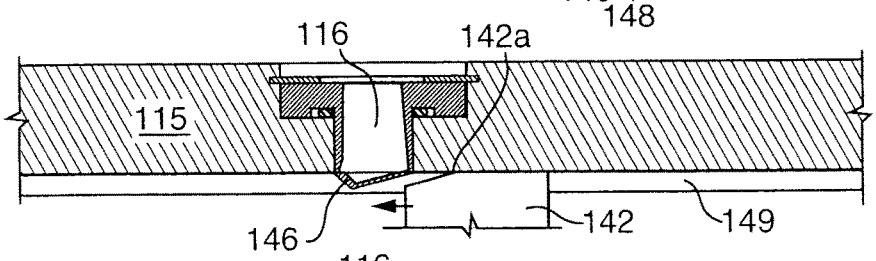
Figure 4C:
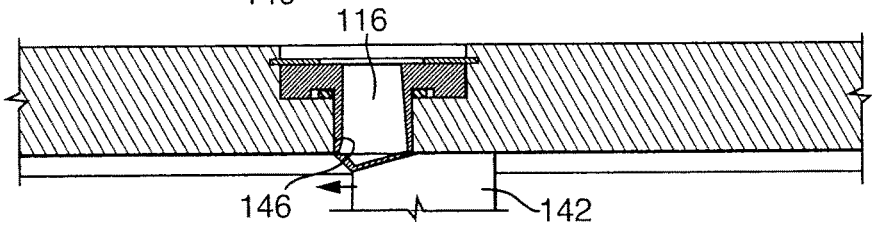
Figure 4D:
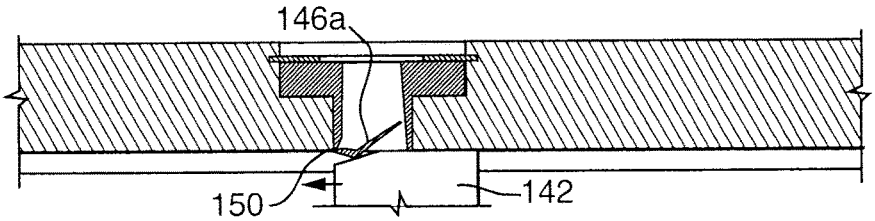
Figure 4E:
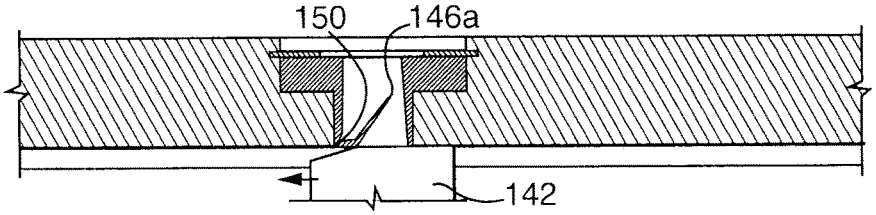
Figure 4F:
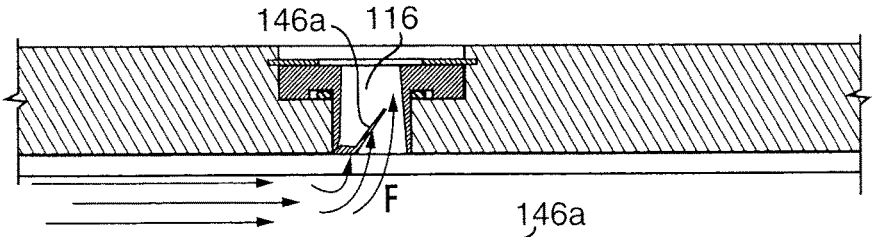
Figure 4G:
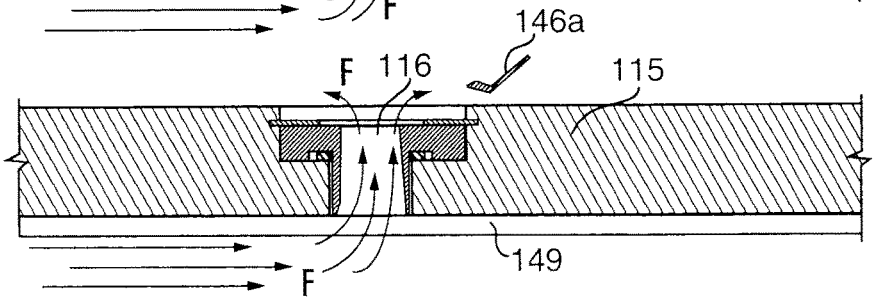

A slot defined by a valley 148 between slot walls 149 may be formed in the liner wall 115 exposed in the liner's inner bore. The width of valley 148, which is the space between the slot walls 149, can be selected with consideration as to the size of the treatment string components such that only selected components can pass into the valley. For example, the valley width can be less than the diamerter of the tubing string such that the slot is sized to prevent the tubing string from entering the valley. Port 116 and cap 146 may be positioned in valley 148 of the slot such that the slot walls protect the cap from being engaged by structures moving therepast in the liner inner bore. In such an embodiment, a finger 142 can be carried on the port-opening tool that can reach into the valley of the slot and open the port by: removing the cap from the port, breaking open the cap, pushing it out through the port, etc. The cap or a portion thereof, when removed from the port, can be dropped into the well or stored. It may be desirable to limit the release of debris into the liner as such debris can interfere with tubing operations, and as such, if all or a portion of the cap is removed altogether when the cap is opened, the portions can be moved into a holder on the liner or the tool or the portions can be pushed out of the liner through the port and into the annulus. In one embodiment, as shown in FIG. 4, the finger can break a top portion of the cap open and push the top portion back into the port. For example, finger 142 can be inserted into valley 148 (FIG. 4*b*) and moved, as by pulling or pushing, past cap 146. In so doing, finger 142, as it passes, can bear against and break open the cap to create a flap 146*a* that is pushed out into the port (FIGS. 4*c* to 4*e*). After acting on the cap, finger 142 may moved to allow fluid access to port 116. For example, as shown in FIG. 4*f*, the finger may be moved with the tool to another position in the well. For example, after the port is opened, the tool can be moved down below the opened port and the seal set to seal the liner below the now opened port 116 in preparation for fracing. The flap 146*a* may be removed completely from its position over the port or, as shown in FIG. 4*f*, may remain connected at a hinge 150. However, regardless, the integrity of the cap is compromised such that a passage is opened therethrough and fluid, such as fracing fluid F, may be pumped out through the opened cap and its associated port 116. As the fluid passes out through the port, the flap may be pushed out of the way and may break free at hinge 150 such that the flap is removed altogether (FIG. 4*g*). However, the force of the fluid pushes the flap through port 116 such that it is expelled from the liner.

Finger 142 may be sized to fit into valley 148 and move therealong to act on cap 146. Finger 142 may have a ramped leading end 142*a* such that it tends not to get caught up on discontinuities in the liner or slot. Alternately or in addition, cap 146 can be formed to present a ramped surface such that finger 142 tends to move over the cap rather than being caught up on it. Also, this forming of the finger and/or the cap tends to urge the cap outwardly through the port rather than contact causing the cap to move into the inner diameter of the liner.

Finger 142 may always protrude in an active position from the port-opening tool or may be moveable from a retracted position to an active position. In one embodiment, for example, the tool may include a finger and a shifting tool to move the finger between a retracted and an exposed, active position. The shifting tool may, for example, be a 360° collet shifting tool that activates the finger. The finger can be moved into an active position by the shifting tool, moved into the valley and moved across the cap to remove the cap.

Figure 5A:
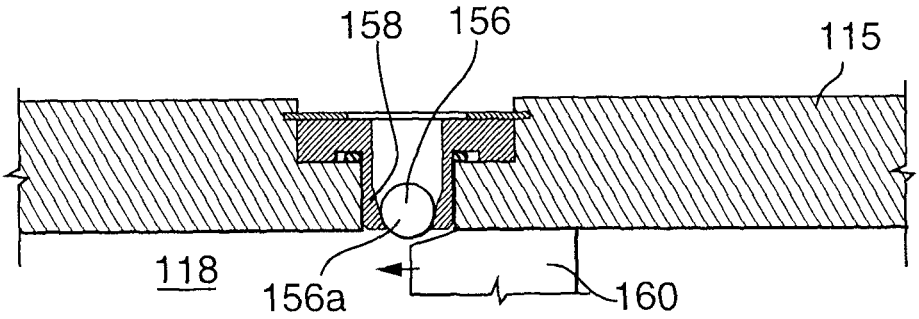
FIGS. 5*a* to 5*c* are sequential schematic sectional drawings along a port showing the opening of a port closure using a treatment string.
Figure 5B:
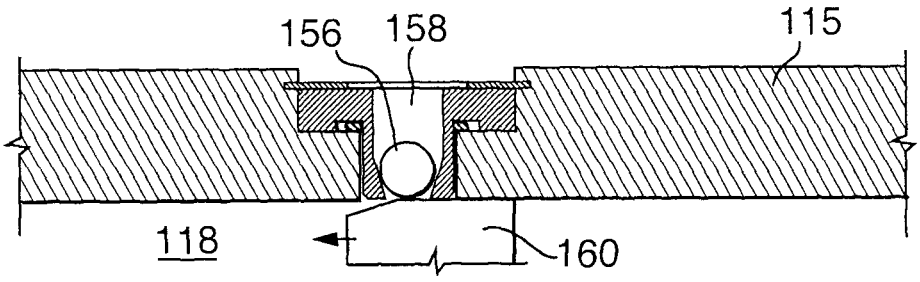
Figure 5C:
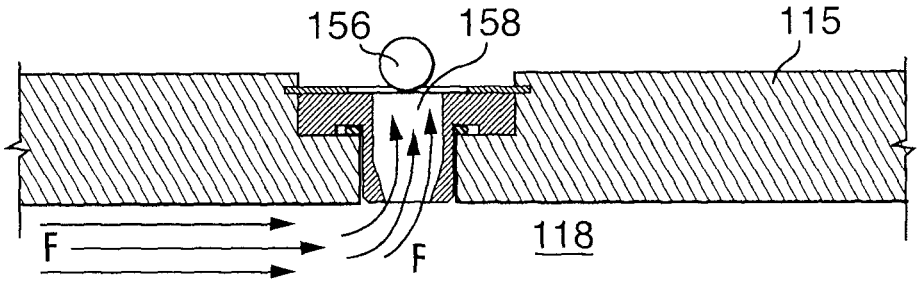

Other cap closures can be employed, such as a plug-type cap closure as shown in FIG. 5. A plug-type cap closure may include a plug installed in port that may be moved out of a sealing position to open the port. For example, a ball-bearing type plug 156 may be installed, as by press fitting, in a narrowed portion of a tapered port 158, defining the port through the liner wall 115. The plug is installed to have a contact portion 156*a* protruding at least a distance into the ID of the liner such that a tool passing through the liner inner bore 118 may contact the plug. The installation of plug 156 in port 158 can be selected to hold the internal pressures intended to be used in the liner, but can be removed from port 158, to open the port, by applying a mechanical force, greater than that force exerted by any operational fluid pressure, against contact portion 156*a* to push it out. Port 158 tapers inwardly from the liner outer surface to the inner bore such that the plug can more easily pass outwardly from the port once it is freed from its installed position. In such an embodiment, the port-opening tool can include a structure such as an anvil 160 that can be moved over the plug to apply a pressure against its portion 156*a* to drive the plug radially outwardly. The pressure frees the plug from its installed position in port 158. An appropriate tool, for example, may include one or more fingers that can move through the liner inner bore 118 and maintain a selected diameter, just slightly less than the liner's drift diameter, for example. After the anvil passes, even if the plug is not fully removed from the port it is loosened and fluid pressure, for example fracing fluid F, can fully eject the plug from the port (FIG. 3*c*). In such an embodiment, plug 156 and port 158 may be installed in a valley to protect the plug from inadvertent strikes by tools passing thereby. However, the low profile presented by the plug's contact portion 156*a* may not readily be affected by occasional abutment of tools passing thereby.

Still other cap closures can be employed, such as a captured cap closure as shown in FIG. 7. In such a system, the cap can be protected from abutment of tools and strings passing thereby and is removable from its port to open it, but the cap remains captured such that it is not released into the tubing string or into the annulus. For example, as shown, a port 316 can have a closure in the form of a cap 346*a*, 346*b*. The cap includes a base portion 346*b* mounted in the port and a top portion 346*a* that can be sheared from the mounted, base portion. An inner channel extends up through the base portion and into top portion 346*a*, but is closed by top portion. The cap controls the ability of fluid to flow through the inner channel forming the port. In particular, when cap portion 346*a* is in place, connected to base portion 346*b*, fluid cannot flow through the port, it being prevented by the solid form of the cap and the seals encircling the base portion. However, when top portion 346*a* is sheared from the base 346*b*, the channel is exposed and fluid can flow there through. While alternatives are possible, in one embodiment, the cap portions 346*a*, 346*b* may be formed as a unitary part and have a solid, fluid impermeable, but weakened area between them.

A sleeve 380 is positioned over port 316 and cap 346. The sleeve includes an inner surface exposed in the inner diameter 318 of the tubing string 315 and an outer surface, facing the tubing string inner wall and including a surface indentation 380*a*. Indentation 380*a* is sized to accommodate top portion 346*a* of the sleeve therein and is formed such that top portion 346*a* remains at all times captured by the sleeve (i.e. cannot pass out from under the sleeve). Sleeve 380 is moveable within the tubing string inner bore from a position overlying the port and accommodating top portion 346*a* while it is still connected to the base portion, in indentation 380*a*. On its inner facing, exposed surface, the sleeve can be contacted by a sleeve shifting tool, a portion of which is indicated at 342. For example, sleeve 380 may include a shoulder 380*b* against which tool 342 can be located and apply force to move the sleeve. Sleeve 380 may be located in an annular recess 381 in order to ensure drift diameter in the tubing string. This positioning also protects the sleeve from inadvertent contact with tools during movement of such tools past the sleeve. Sleeve 380 can include a lock to ensure positional maintenance in the string. For example, sleeve 380 may carry a snap ring 382 positioned to land in a gland 388 in the tubing string inner wall, when the snap ring is aligned with the gland.

Sleeve 380 can be moved to shear the cap and open the port, while retaining the sheared top portion 346*a* in the indentation. For example, during run in and before it is desired to open the port to fluid flow therethrough (FIG. 7*a*), the cap's top portion 346*a* remains connected and sealed with base portion 346*b*. Sleeve 380 is positioned over the port with portion 346*a* positioned in indentation 380*a*.

Figure 7A:
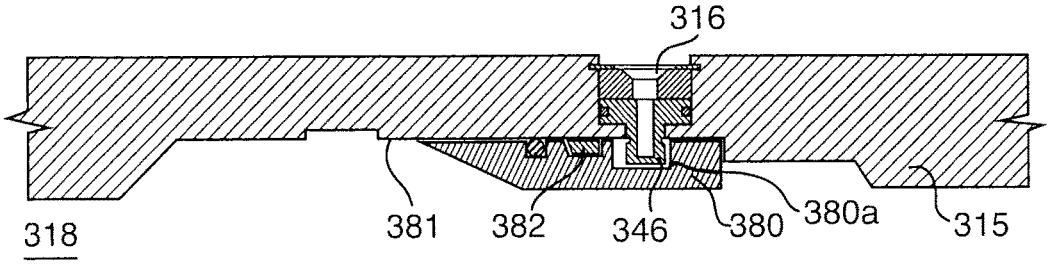
FIGS. 7*a* to 7*d* are sequential schematic sectional drawings along a port showing the opening of a port closure using a treatment string.
Figure 7B:
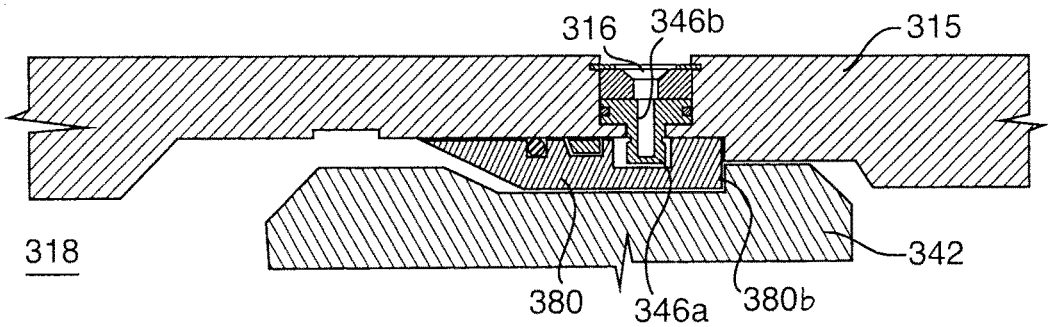
Figure 7C:
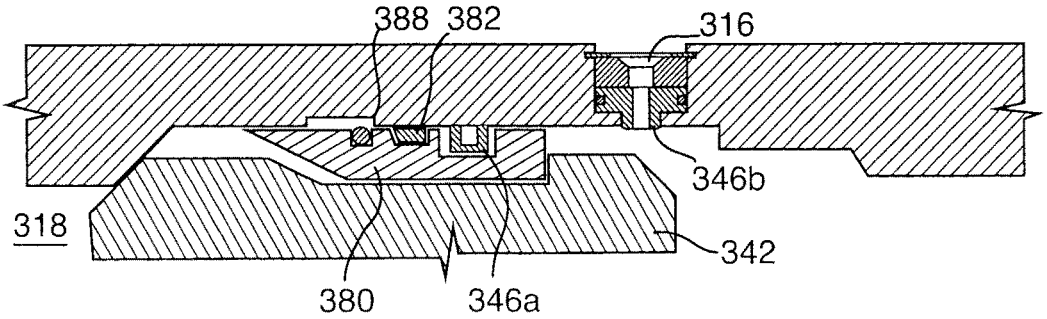

When it is desired to open the port, sleeve 380 can be moved, as by landing a tool 342 against the sleeve, such as shoulder 380*b* of the sleeve, (FIG. 7*b*) and, applying a push, pull or rotational force to the sleeve to move it along the tubing string (FIG. 7*c*). When sleeve 380 moves, force is applied to the cap top portion 346*a* by abutment of the side walls of the indentation against portion 346*a*. Since top portion 346*a* is urged to move, while base 346*b* is fixed, portion 346*a* becomes sheared from base portion 346*b*. While removal of top portion 346*a* opens the port, the sleeve 380 with the sheared top portion 346*a* captured therein can be slid until it fully exposes port to the inner bore. For example, sleeve 380 can be moved until it becomes locked, as by snap ring 382 landing in gland 388 in a displaced position, while top cap portion 346*a* remains captured in indentation 380*a*.

Figure 7D:
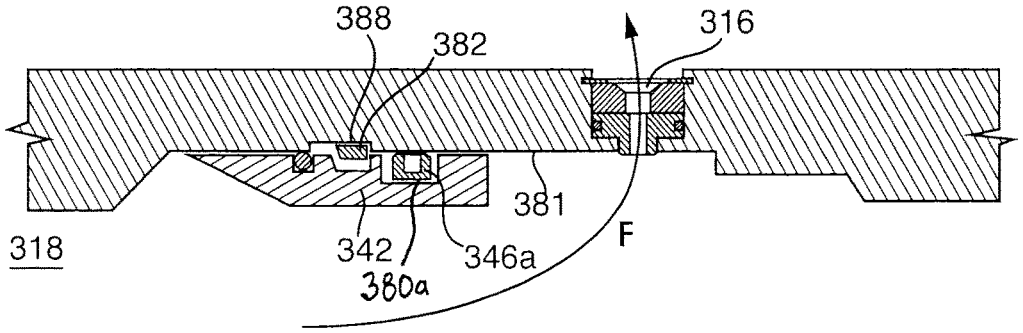

Fluid, such as fracing fluid F, may be pumped out through the channel forming port 316, which is exposed by opening the cap (FIG. 7*d*).

Another cap closure (not shown) can include a shearable cap portion that after shearing becomes captured in a cavity in the tubing string inner wall. In one embodiment, such a cap closure can be installed in a recessed position, for example, in a slot and after being sheared off, the sheared top becomes jammed under a return or in a blind end of the slot.

It will be appreciated, therefore, that various port closures may be employed.

As shown, the treatment string assembly may be formed of a plurality of parts connected together. For example, as shown the seals, ports, etc. may be formed/mounted on a head component which is attached to the remainder of the string. For example, in such an embodiment, the head can include a bore that can be placed into communication to act as one with the inner bore of the string, such that together they define inner bore 37.

Tubing string assembly 14 may further include centralizers to urge the string into a more concentric position as it passes through the liner, thus avoiding uneven wear about seal 32.

In operation, the liner may be run in and positioned downhole in a wellbore 12 with its ports 16*a*, 16*b* positioned adjacent one or more target formations to be treated.

The wellbore may take various forms. For example it may be in any one of various orientations including main, lateral, vertical, non-vertical such as horizontal, cased, open hole (uncased). In the illustrated embodiment of FIGS. 1 to 3, wellbore 12 is open hole and generally horizontally oriented.

The liner may be run into the hole in any of various ways. The liner may be positioned and installed in a temporary manner or in a more permanent manner. In one embodiment, seals 26', 26" are installed, as by use of annular packers, etc. in the annulus between the liner outer surface 20 and the wellbore 12 between ports 16*a*, 16*b* to prevent annular fluid communication from one port 16*a* to another port 16*b* through the annulus. Again, as noted above, there may be further ports along the string, axially spaced relative to the first and second ports. Such further ports may be separated by seals 26 or not.

Where the liner includes selectively closeable ports, the liner may be run in with the ports open or closed. In one embodiment, such as the one shown, the liner is run in with the ports 16*a*, 16*b* closed by sleeves 24*a*, 24*b*, respectively.

When the liner is positioned, tubing string assembly 14 is introduced into the liner inner diameter.

Where liner 10 includes sleeves, port-opening tool 40 may be operated to move a sleeve to a port-open position prior to introducing wellbore treatment fluid. For example, as shown, the member 42 on the tool may engage a selected sleeve 24*b* and the string may be pulled or pushed or hydraulics actuated to drive the sleeve along the liner away from its port 16*b* to expose the port to the inner bore pressure.

Tubing string assembly 14 is useful to create a seal below a port 16 such that fluid introduced from surface through the liner may be controlled thereby. In particular, tubing string assembly 14 may be run into the liner and positioned to place seal 32, which is carried on it, into a sealing position against the liner inner wall such that fluid cannot pass along annular area 36 at this point. In one embodiment, then, the method may include introducing wellbore treatment fluid from surface, which fluid is directed by seal 32 to a particular area of the well. For example in one embodiment, fluid can be directed from surface down annular area 36. Alternately, fluid may be introduced from surface through inner bore 37 of the string and can pass from the tubing string through its port 38 into annular area 36. Regardless, fluid, arrows F, will be stopped from further movement downhole by seal 32. Fluid stopped by seal 32 can be directed out through any opened ports 16*b* thereabove to enter the wellbore, where it can treat the formation of interest.

In one embodiment, a method of preparing for injection of fluid may include positioning the port-opening tool 40 adjacent a closed sleeve, moving the tool until it engages the sleeve, and driving the sleeve with the tool, possibly by pushing or pulling on tubing string 30 connected to tool 40 to, in turn, drive the sleeve to open its port. The direction of sleeve and tool movement may be up, down or rotationally, as desired. If the opening of the sleeve is accomplished by movement of the tool downwardly, away from surface, this movement also brings the seal of the treatment string below that opened port. If that opened port is the lowest one through which the fracing operation is to be conducted, no further string manipulation is required after opening the sleeve. In particular, the seal will be below the port and it can be set in this position.

Generally, the lowermost port of interest in the liner, in this case port 16*b*, is treated first and the tubing string is moved up hole to treat through the remaining ports, such as port 16*a*. Seal 32 acts to isolate conditions uphole of the seal from conditions downhole of the seal. By moving up in the well, the ports below the position of the seal can remain open without pressure conditions above the seal affecting them.

Pressure conditions can be monitored through the system, as desired, since it offers a dead string. In one embodiment, an accurate assessment of above-port fluid treatment pressure can be obtained by monitoring down the conduit; either annular area 36 or inner bore 37 of the string, not being used to convey wellbore treatment fluid. For example, if the treatment fluid is introduced through the annular area 36, as shown, then above-port pressure, such as frac pressure, can be monitored through inner bore 37 of the string. Since such pressure monitoring is substantially not hindered by friction, the pressure readings may be particularly accurate. In an embodiment including a valve 39, the conditions in inner bore 37 may be pressure isolated from annular area 36. In such an embodiment, a small amount of fluid may be passed through the valve to open the pressure communication for pressure monitoring.

In one embodiment, the method includes conveyance of proppant with the wellbore treatment fluid. In one embodiment, fluid treatment can continue until a screening out (also termed sanded out) condition is approached or exists. For example, in some cases it is advantageous to pump sand at a high enough concentration to ensure a screen out condition is reached. In some cases, screening out is of interest, as it the condition urges a considerable amount, and possibly a maximum amount of proppant in the formation crack forming the fracture, as such it ensures that the fracture is held open. A screen out condition is generally indicated by an increase in pressure during a fracturing process. However, because the residue after screening out, including excess sand, may lead to a struck treatment string, screening out is normally avoided. While it is normally advised to avoid screening out, the present system allows an operator to screen out on the job and then recover quickly by circulating or reverse circulating to remove the screen out residue, including the excess sand. In such an embodiment, recovery circulation can be commenced to remove at least some of the sand/proppant and gel, if any, from between the string and the liner to permit either fluid treatment to continue or the tubing string to be moved along the liner. Recovery circulation may be in a direction that best removes the accumulated sand/proppant, for example, from below the accumulation. Alternately or accordingly, recovery circulation may be in the reverse direction relative to the treatment direction of flow. For example, if wellbore fluid treatment proceeds, as shown, by introducing fluid down through the annulus and out through port 16*b*, reverse flow can be established through inner bore 37, through port 38 and up through annular area to lift sand/proppant out from the annular area. In such an embodiment, valve 39 may be useful to prevent flow from annular area 36 into the inner bore 37, while permitting flow in the opposite direction. In an alternate embodiment, circulation to remove the screen out residual may be down the annular area and up through the string. These methods and assemblies are particularly useful, therefore, if the formation accessed through the ports responds to high proppant densities. In one embodiment, one or more zones in the formation can be intentionally screened out. This may be useful in heavy oil or prolific formations. Generally, in such a method, a pad of treatment fluid is introduced first followed by the proppant-laden fluid. Pumping can continue until pressure is sensed to increase indicating that the fracture has screened out. After screening out, the system can be recovered by circulation up or down through the tubing string 30.

After treatment at one port, the tubing string assembly may be moved to another port and the process can be repeated. Generally, the next port will be uphole from the first since the ports uphole can be selectively closed, as by sleeves or other closures, only to be opened when it is time to treat through the port. Ports below can remain open, since seal 32, when set, provides isolation of treatment fluids from any ports therebelow.

If desired, treatments may be though only selected ports in the liner. If non-selected ports are closed, the tool can be moved past the port without manipulation related thereto.

If desired, tool 40 can be actuated to close a sleeve over its associated port either before or after moving to a next port for treatment thereof. Alternately, at any time after string assembly 14 is removed from the liner, that or another string assembly may be run into the liner to close or reopen the one or more sleeves 24.

Generally, after wellbore treatment, the ports will be left open to allow the well to produce. If the sleeves are positioned in annular recesses, the liner will be in a full open bore condition and there is no need to drill out the liner.

In another embodiment shown in FIG. 6, a series of ports in the liner string are all opened before the sealing member is set below the most downhole port of the opened ports in that series. As such, any number of ports can be opened, such as one to four or more, and then the string can be moved down to locate and set the seal below the opened port in the series that is furthest downhole to seal off below the series of opened ports. Thereafter, a wellbore fluid treatment operation, such as a fracing operation, can be initiated down the annular area or through the tubing string to simultaneously frac through the ports in the series. The ports may be opened to one or more packer isolated intervals in the well. The system may use a limited entry type technique to ensure the frac fluid is appropriately distributed between the ports. In a limited entry system, a sized nozzle is installed in at least some of the ports in the series to allow distribution of the fluid in an appropriate and planned manner through all the ports in the series, to be opened and fraced simultaneously.

In this embodiment, the method includes running into the well with a liner 215 including a plurality of selectively openable ports including at least one series of selectively openable ports 216*a*, 216*b*, 216*c*. The liner can be set in the well to create an annulus 213 between the wellbore wall 212 and the liner. If desired, without cementing the annulus, isolated intervals can be established along the well by setting liner-conveyed packers 226', 226", 226'" to create annular seals in the annulus. The space between each adjacent two packers represents an isolated interval and the ports are each positioned to provide communication from the liner inner bore 218 to an isolated interval. Some isolated intervals, such as that between seal 226' and seal 226" can be accessed by more than one axially spaced port. The series of ports can be in the same interval, with a packer on either side of the series, but not separating annular communication between the ports of the series, or, as shown, packers can be installed to separate one or more of the ports in the series from one or more other ports in the series.

In this illustrated embodiment, ports 216*a*, 216*b*, 216*c* when run in are each closed by a cap-type closure 246, but can be selectively opened by operation of a port-opening tool 240 carried on a treatment string assembly 214 that can be moved through the liner inner bore. Treatment string assembly 214 also includes a tubing string 230 with an inner conduit in fluid communication with surface, a closed bottom end 230*a*, a seal, such as a settable/releasable packer 232, carried on the string and actuable to create a seal between the tubing string and liner 215, a port 238 providing fluid communication, when opened, between the outer surface of the tubing string and the inner conduit above the seal (on a side of the seal opposite bottom end 230*a*) and a port-opening tool 240 carried on the string.

The liner and treatment string components can be selected according to various options, including any of the options as described above in FIG. 1 to 5 or 7.

When it is time to begin a wellbore fluid treatment, such as a fracing operation, at least one port below port 216*c* adjacent a distal, lower end of the liner is opened to permit fluid communication between the liner inner bore and the wellbore annulus 213. To do this various opening procedures can be employed, for example, the at least one port can be opened by pressuring up the liner and bursting a plug or hydraulically actuating the opening of a closure or by running in the treatment string and activating the port's closure by tool 240. Once the at least one port is opened, if desired, a fracing operation can be pumped for any zones communicated through that at least one port. The treatment string 214 can be in the liner, for example, positioned with its sealing member 232 below that at least one port or positioned anywhere with sealing member 232 unset. Alternately, the treatment string may not yet be installed in the liner.

Figure 6A:
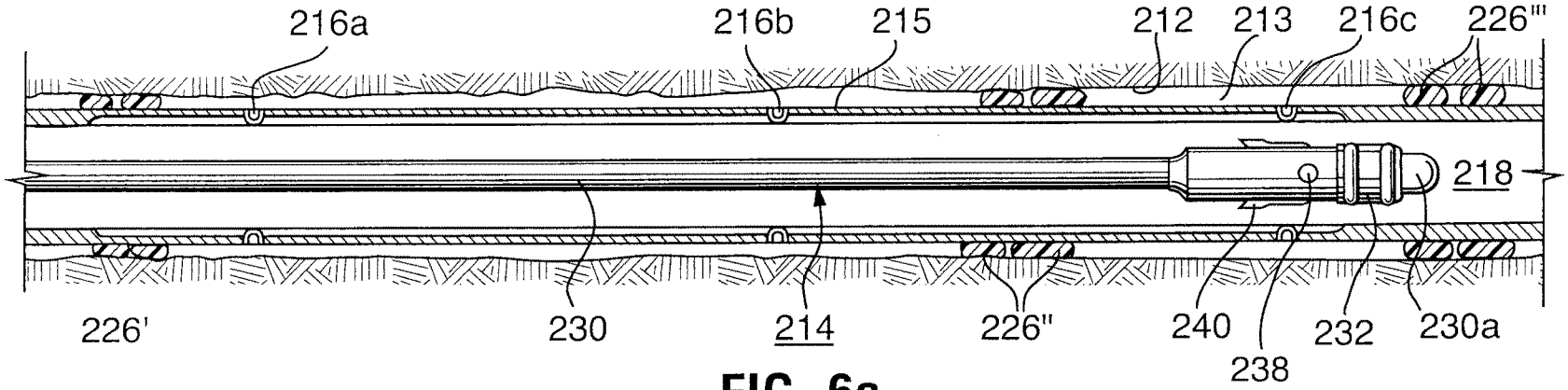
FIGS. 6*a* to 6*f* are sequential schematic sectional views through a wellbore during a wellbore treatment.
Figure 6B:
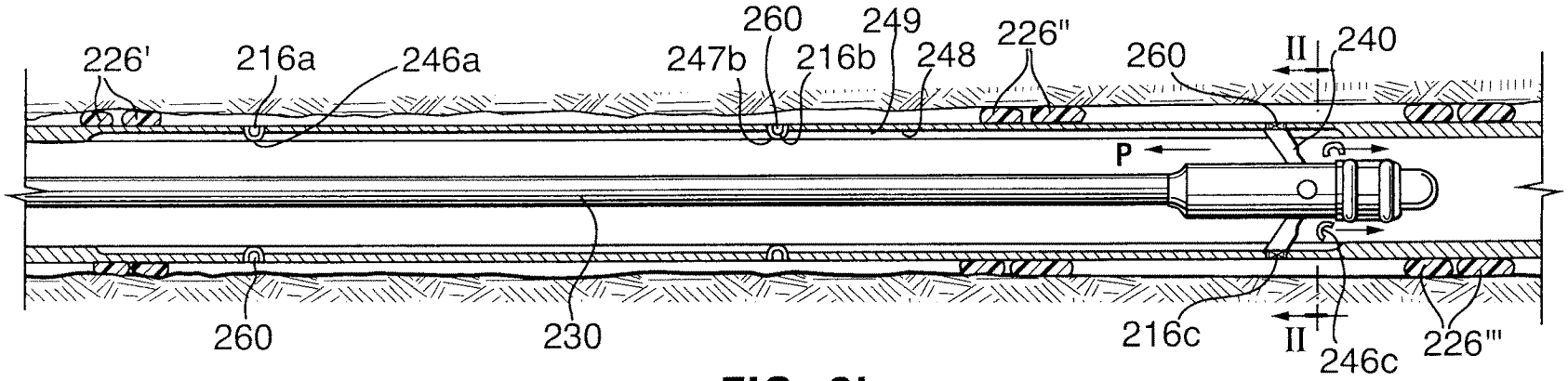
Figure 6C:
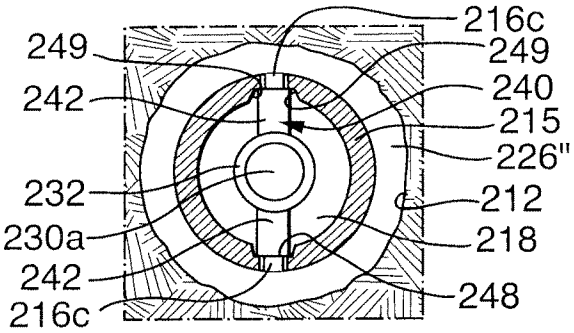

After the fracing operation through the at least one port is complete, the treatment string can be moved or introduced to a next series of ports through which a fracing operation is to be conducted (FIG. 6*a*). The next series of ports can be one or more ports, for example, ports 216*a*, 216*b*, 216*c*, as shown. This next series of ports can be above (closer to surface) than the at least one port opened below and through which a fracing operation may have already been conducted.

Figure 6D:
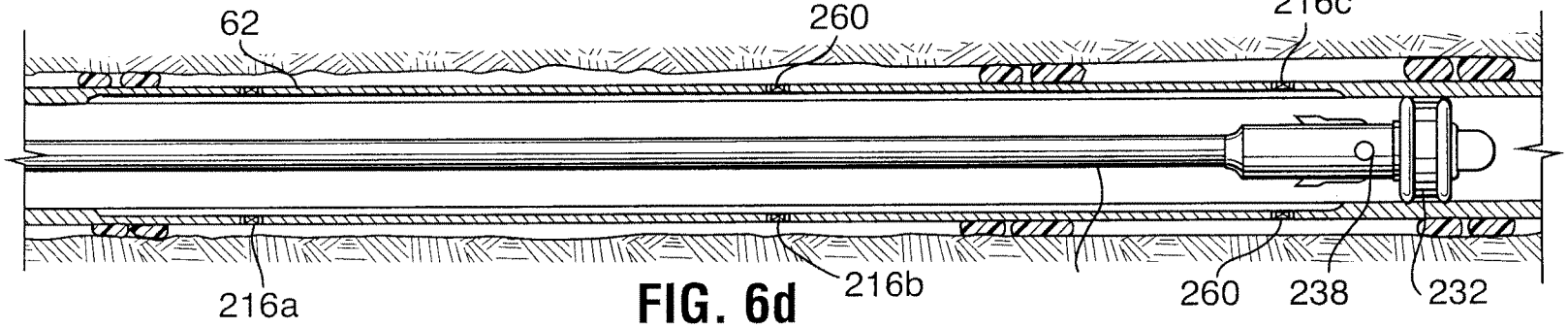

Preparations are then carried out for fluid treatment through the next series of ports. First, the next series of ports are opened (FIGS. 6*b* and 6*c*) to provide for fluid communication between inner bore 218 and annulus 213. To do this, the port-opening tool 240 can be moved to the ports to open their closures 246. For example, port-opening tool 240 can be moved, arrow P, from port to port in the series of ports and can actuate the ports to open. In one embodiment, as the shifting tool is moved through the liner inner bore, the port-opening tool, if not already in position, can be activated into an active position to open the ports. Activation of tool 240 can be by pressure, by flow or by the directional movement up or down. The operation to open the ports depends on the type of closures covering the ports and how they are opened, as noted herein above. After the series of ports 216*a*, 216*b*, 216*c* are open, the string 230 is moved downhole below the lowermost of the ports in the series, in this case port 216*c*, and the seal member 232 is then set to seal off the annular area 236 between the liner and the string to isolate all the zones below from the series of opened ports (FIG. 6*d*).

Figure 6E:
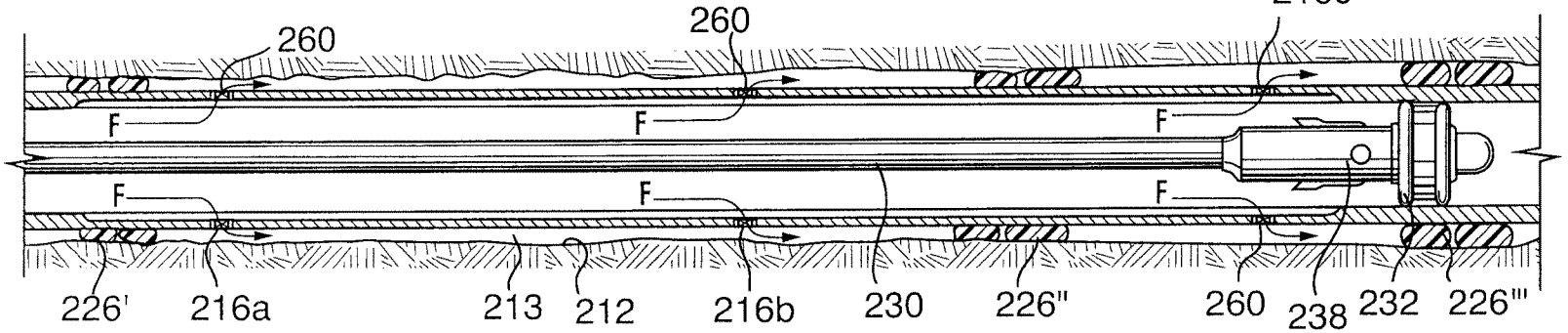
Figure 6F:
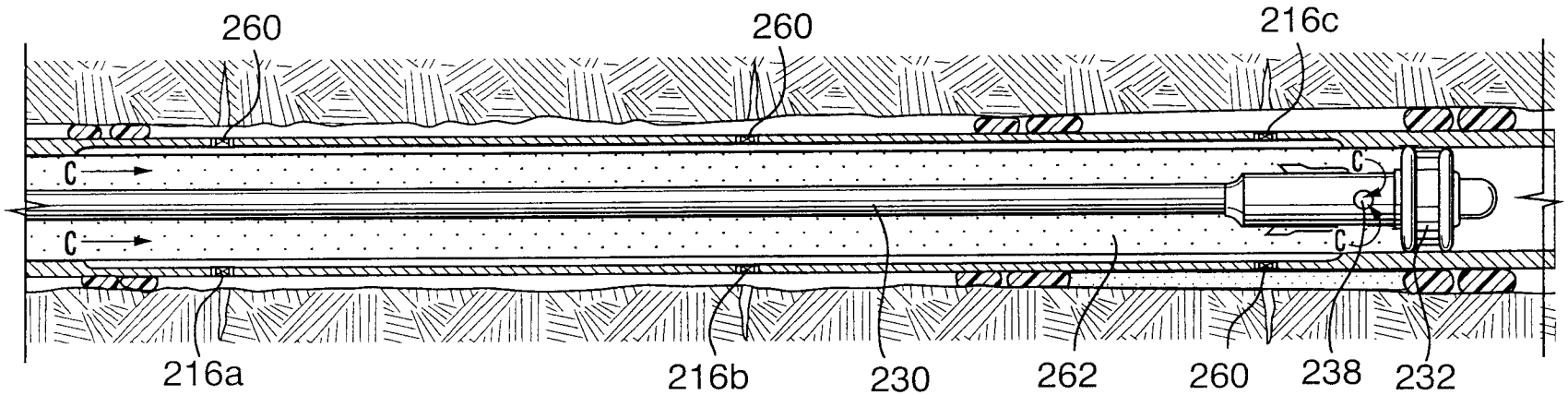

Once all the selected ports are opened and the liner below the opened ports is sealed, then fluid can be introduced, arrows F, to treat the wellbore through the opened ports (FIG. 6*e*). For example, as shown, one or more wellbore intervals can be fraced simultaneously through the opened series of ports. Ports 216*a*, 216*b*, 216*c* in the series can include valves 260 therein to provide for limited entry and, thereby, appropriate distribution of fluids through the ports in the series. Wellbore treatment fluids can be introduced from surface through the annular area 236 and/or through the tubing string inner bore, exiting through port 238. In the illustrated embodiment, wellbore fracing fluids are introduced from surface through the annular area 236 and port 238 is open to monitor downhole pressure conditions. String 230 remains pressurized to ensure fluids do not circulate upwardly therethrough. Fracing fluids F exit through ports 216*a*, 216*b*, 216*c* into the annulus 213 and into contact with the open hole wellbore wall along the intervals between packers 226' and 226" and between packers 226" and 226'''.

If desired, this system can be employed to generate a screen out condition through all ports 216*a*, 216*b*, 216*c* in the series and thereafter recover quickly. For example, after simultaneously fracing through the series of the ports, for example by introducing fracing fluid down the annulus between the tubing string and the liner, proppant can be introduced until an intentional screen out condition is reached at the series of ports. After the screen out condition is sensed (FIG. 6*f*), fluid circulation, forward circulation (arrows C as shown) or reverse circulation, can be initiated between annular area 236 and the fluid conduit in string 230, through port 238, to lift out the remaining sand and gel 262 that hasn't been placed in the fractures. As such, after screening out, the liner can be cleaned out quickly to free the string such that it can be moved to treat a next port or series of ports. All of the ports in the screened out series can be cleaned out with one circulation process.

The foregoing process can be repeated at a plurality of series of ports moving up through the liner, with or without screening out through each series. For example, after fluid treatment and removal of screen out residual, if any, the packer can be unset and the treatment string assembly may be moved upwardly in the liner to a next series of one or more ports, the port-opening tool can be manipulated to open the ports in that next series, the treatment string assembly can be moved below the lowermost of the opened ports in that next series where the sealing member can be set to seal the annular area and a fluid treatment can be conducted through the opened ports.

The process and system therefore allows an operator to access and treat multiple intervals at the same time and, so, provides significant savings in terms of time and cost. Also, the process and system introduce additional efficiencies, allowing a screen out condition to be achieved intentionally, if desired, such that a high conductivity can be maintained, as a maximum amount of sand can be introduced in each of the fractures generated. The process and system allow an operator to intentionally screen out on one or more zones through one or more ports along a liner and then quickly recover to move to a next interval to frac that interval through one or more ports and screen out if desired.

While various port closures can be employed, FIG. 6 show a cap-type port closures 246*a*, 246*b*, 246*c* removed by shearing and protected by inadvertent removal by placement in a slot along the liner wall. The slot may be formed in the wall of the liner and may be exposed in the inner bore 218. The slot forms a valley 248 between slot walls 249. Each cap 246 may be positioned in the valley of the slot such that the slot walls protect the cap from being engaged by structures moving therepast in the liner inner bore. Port-opening tool 240 includes a pair of diametrically opposed fingers 242 with cutters formed at the outboard tips thereof. The fingers and cutters are sized to penetrate between the slot walls and ride along the valley removing the caps from the ports by shearing them off (cap 246*c*, FIG. 6*b*).

In this illustrated embodiment, the slot extends along the liner wall between the ports in at least a series of ports such that when the fingers are expanded and located in the slot the tool can be moved along the liner, with the fingers remaining in their slots to open a plurality of closures without needing to rotationally relocate the tool for each port. Alternately, the slot may span fewer ports than those to be opened in one stage of the operation. For example, the slot may accommodate only one port. This may require that the tool fingers be located in a number of slots during one stage of the opening operation for a series of ports, before positioning the seal below all the opened ports and before pumping treatment fluids. However, this does not present a significant challenge and simplifies string manufacture and design.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A treatment string assembly insertable into a liner for wellbore treatment comprising:

a tubing string with an outer surface forming an inner fluid conduit through which fluid can be conveyed, a fluid communication port permitting fluid communication between the outer surface and the inner fluid conduit, a port-opening tool carried on the tubing string, and a valve in the fluid communication port, and settable annular seal about the outer surface of the tubing string positioned downhole from the fluid communication port, wherein the valve is adapted to open pressure communication through the fluid communication port between an annular area defined by the assembly in the liner, and the inner conduit, to enable pressure monitoring of the annular area when the annular seal is set.

2. The assembly of claim 1 wherein the valve in the fluid communication port is adapted to restrict fluid flow through the fluid communication port in one selected direction.

3. The assembly of claim 1 wherein the tubing string is coiled tubing.

4. The assembly of claim 1 wherein the valve in the fluid communication port is adapted to restrict fluid flow between the inner fluid conduit and the annulus at selected pressures.

5. The assembly of claim 1, wherein the annular seal is adapted to assume a set position, wherein fluid is prevented to flow past the seal, and an unset position when the treatment string assembly is enabled to travel to a position of interest within the liner.

6. The assembly of claim 1, wherein the annular seal includes one or more annular members.

7. The assembly of claim 6, wherein the annular members are compressible, inflatable or extrudable packers.

8. The assembly of claim 6, wherein the annular member is a polished bore receptacle seal selected to create a seal with a polished bore receptacle provided in the inner surface of the liner.

9. The assembly of claim 1, wherein the tubing string operates as a dead string to assess the above-port fluid pressure by monitoring down the inner fluid conduit, when fluid is introduced in the annulus.

10. A method for wellbore treatment monitoring, comprising:

running a liner in a wellbore, the liner including a wall, an inner bore defined by the wall, a first liner port through the wall, a second liner port though the wall spaced axially from the first liner port, a first removable closure for the first liner port and a second removable closure for the second liner port to form an annulus between the liner wall and the wellbore;

inserting a treatment string assembly into the liner, the treatment string assembly including a tubing string including an inner fluid conduit, a fluid communication port, and a settable annular seal about the tubing string;

manipulating the treatment string assembly to remove the second removable closure to open the second liner port;

setting the annular seal to create a seal between the tubing string and the liner downhole of the second liner port;

while the first liner port is closed to fluid flow, pumping wellbore treatment fluid into an annular area established between the tubing string and the liner wall such that the fluid passes enabling through the second liner port and into the annulus;

opening pressure communication through the fluid communication port between the annular area and the inner conduit; and monitoring pressure conditions through the inner fluid conduit, while maintaining the fluid communication port open and pressurizing the tubing string.

11. The method of claim 10 further comprising introducing proppant to the annular area above the annular seal such that the proppant passes through the second liner port and into the annulus to create a screen out condition.

12. The method of claim 11 further comprising allowing fluid communication between the annular area and the inner fluid conduit to permit removal of screen out residual from the annular area above the annular seal.

13. The method of claim 10 further comprising a third liner port extending through the wall spaced axially from the first liner port and the second liner port and wherein during pumping wellbore treatment fluid into the annular area, fluid passes through the second liner port and the third liner port simultaneously to treat the wellbore adjacent the second liner port and the third liner port respectively.

14. The method of claim 10 further comprising, after pumping wellbore treatment fluid, manipulating the treatment string assembly to close the second liner port.

15. A method for wellbore treatment, comprising:

running a liner in a wellbore, the liner including an inner bore defined by a wall and a liner port through the wall;

inserting a treatment string assembly into the liner, the treatment string assembly comprising: a tubing string having an inner fluid conduit, a port opening tool, an annular seal adjacent the port opening tool in the liner; and a fluid communication port permitting fluid communication to and from the inner fluid conduit;

setting the annular seal to seal the liner downhole of the liner port;

pumping wellbore treatment fluid into an annular area between the tubing string and the liner wall, such that the fluid passes through the liner port to treat an open hole section of the wellbore adjacent the liner port;

enabling a small amount of fluid to pass between the inner bore and the annular area through the fluid communication port while pumping, to open pressure communication between the annular area and the inner conduit;

monitoring of the wellbore pressure conditions in the annular area by operating the treatment string assembly as a dead string.

16. The method of claim 15, further comprising detecting occurrence of a screen-out condition in the annular space area based on the monitoring of wellbore pressure conditions.

17. The method of claim 15, further comprising recovering from a screen-out condition by reverse circulating wellbore treatment fluid from the inner fluid conduit to the annular area through the fluid communication port.

18. The method of claim 15, wherein operating the treatment string assembly as a dead string comprises:

introducing wellbore treatment fluid from surface through the annular area;

maintaining the fluid communication port open; and pressurizing the tubing string.

* * * * *